US008408173B2

(12) United States Patent
Cho et al.

(10) Patent No.: US 8,408,173 B2
(45) Date of Patent: Apr. 2, 2013

(54) ELECTRO-HYDRAULIC VARIABLE VALVE LIFT APPARATUS

(75) Inventors: Myung Rae Cho, Incheon (KR); Hong Wook Lee, Yongin (KR); Taewon Park, Hwaseong-si (KR); Woo Tae Kim, Suwon (KR); Myung Sik Choi, Seoul (KR); Eui Chul Choi, Seoul (KR); Won Gyu Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 320 days.

(21) Appl. No.: 12/878,709

(22) Filed: Sep. 9, 2010

(65) Prior Publication Data

US 2011/0132301 A1 Jun. 9, 2011

(30) Foreign Application Priority Data

Dec. 4, 2009 (KR) ..... 10-2009-0120098

(51) Int. Cl.
*F01L 1/34* (2006.01)

(52) U.S. Cl. ..... 123/90.16; 123/90.48; 123/90.12

(58) Field of Classification Search ..... 123/90.16, 123/90.48, 90.44, 90.12
See application file for complete search history.

(56) References Cited

U.S. PATENT DOCUMENTS 4,287,977 A * 9/1981 Haga et al. ..... 192/85.5
4,796,573 A * 1/1989 Wakeman et al. ..... 123/90.16

FOREIGN PATENT DOCUMENTS

KR 1995-0014404 B1 11/1995

* cited by examiner

*Primary Examiner* — Zelalem Eshete
(74) *Attorney, Agent, or Firm* — Morgan, Lewis & Bockius LLP

(57) ABSTRACT

An electro-hydraulic variable valve lift apparatus may include a valve unit housing of which a guide protrude portion is formed therein, a main piston which is slidably disposed in the valve unit housing and defines a valve adjusting oil chamber with the valve unit housing, a main spring which is disposed within the valve adjusting oil chamber and elastically supports the main piston on the guide protrude portion, a dependent piston which is slidably disposed within the valve unit housing, is guided along the guide protrude portion, reciprocates according to reciprocation of the main piston, and opens a valve, and a main oil supply portion which selectively supplies hydraulic pressure to the valve adjusting oil chamber.

12 Claims, 7 Drawing Sheets

ELECTRO-HYDRAULIC VARIABLE VALVE LIFT APPARATUS

CROSS-REFERENCE TO RELATED APPLICATION

The present application claims priority to Korean Patent Application No. 10-2009-0120098 filed in the Korean Intellectual Property Office on Dec. 4, 2009, the entire contents of which is incorporated herein for all purposes by this reference.

BACKGROUND OF THE INVENTION

1. Field of the Invention

The present invention relates to a variable valve lift apparatus. More particularly, the present invention relates to an electro-hydraulic variable valve lift apparatus.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches have been undertaken. For example, research has been undertaken for a variable valve lift (VVL) apparatus that enables different lifts depending on an engine speed, and for a variable valve timing (VVT) apparatus that opens/closes the valves with different timing depending on the engine speed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

An electro-hydraulic variable valve lift apparatus may include a valve unit housing of which a guide protrude portion is formed therein, a main piston which is slidably disposed in the valve unit housing and defines a valve adjusting oil chamber with the valve unit housing, a main spring which is disposed within the valve adjusting oil chamber and elastically supports the main piston on the guide protrude portion, a dependent piston which is slidably disposed within the valve unit housing, is guided along the guide protrude portion, reciprocates according to reciprocation of the main piston, and opens a valve, and a main oil supply portion which selectively supplies hydraulic pressure to the valve adjusting oil chamber.

The dependent piston may include a first dependent piston body guided along the guide protrude portion, and a second dependent piston body guided along the valve unit housing, wherein the dependent piston may further include a valve lash adjusting piston which is disposed within the second dependent piston body and defines a valve lash adjusting chamber with the second dependent piston body, a valve lash adjusting spring which is disposed within the second dependent piston body and elastically supports the valve lash adjusting piston, and a valve lash adjusting oil supply portion which supplies oil to the valve lash adjusting chamber.

The apparatus may further include a check valve which is disposed between the valve lash adjusting oil supply portion and the valve lash adjusting chamber.

A plurality of grooves may be formed to the first dependent piston body along reciprocal motion direction of the dependent piston, wherein the plurality of grooves is formed on an outer circumference of the first dependent piston body.

A plurality of grooves is formed to the first dependent piston body along reciprocal motion direction of the dependent piston and at least one groove is longer than the other grooves to be fluid-connected to the valve adjusting oil chamber, wherein the plurality of grooves are formed on an outer circumference of the first dependent piston body.

The guide protrude portion, the second dependent piston body and the valve unit housing may define an auxiliary chamber therebetween, and a first impact reducing oil passage may be formed to the dependent piston and connects the valve adjusting oil chamber and the auxiliary chamber, wherein the apparatus further includes a second impact reducing oil passage which is diverged from the first impact reducing oil passage toward the guide protrude portion such that the second impact reducing oil passage is selectively blocked by the guide protrude portion in accordance with reciprocal motion of the dependent piston.

In another aspect of the present invention, the electro-hydraulic variable valve lift apparatus may include a valve unit housing, a main piston which is slidably disposed in the valve unit housing and defines a valve adjusting oil chamber with the valve unit housing, a main spring which is disposed within the valve adjusting oil chamber and elastically supports the main piston, a dependent piston which is guided along the valve unit housing, reciprocates according to reciprocation of the main piston, and opens a valve, and a main oil supply portion which supplies hydraulic pressure to the valve adjusting oil chamber, wherein the apparatus further includes a guide protrude portion formed to the valve unit housing, and the dependent piston may include a first dependent piston body guided along the guide protrude portion, and a second dependent piston body guided along the valve unit housing, wherein a plurality of grooves are formed to the first dependent piston body along reciprocal motion direction of the dependent piston.

The plurality of grooves may be formed on an outer circumference of the first dependent piston body.

The guide protrude portion may be disposed in the valve unit housing and the main spring is positioned between the guide protrude portion and the main piston.

The apparatus may further include a guide protrude portion formed to the valve unit housing, and the dependent piston may include a first dependent piston body guided along the guide protrude portion, and a second dependent piston body guided along the valve unit housing, wherein the guide protrude portion, the second dependent piston body and the valve unit housing define an auxiliary chamber therebetween, a first impact reducing oil passage is formed to the dependent piston for connecting the valve adjusting oil chamber and the auxiliary chamber, and a second impact reducing oil passage is diverged from the first impact reducing oil passage toward the guide protrude portion such that the second impact reducing oil passage is selectively blocked by the guide protrude portion in accordance with reciprocal motion of the dependent piston, wherein the guide protrude portion is disposed in the valve unit housing and the main spring is positioned between the guide protrude portion and the main piston.

The electro-hydraulic variable valve lift apparatus according to exemplary embodiments of the present invention may be realized with simple elements and simple oil passages so that manufacturing cost can be reduce and impacts of opening and closing of a valve can be reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
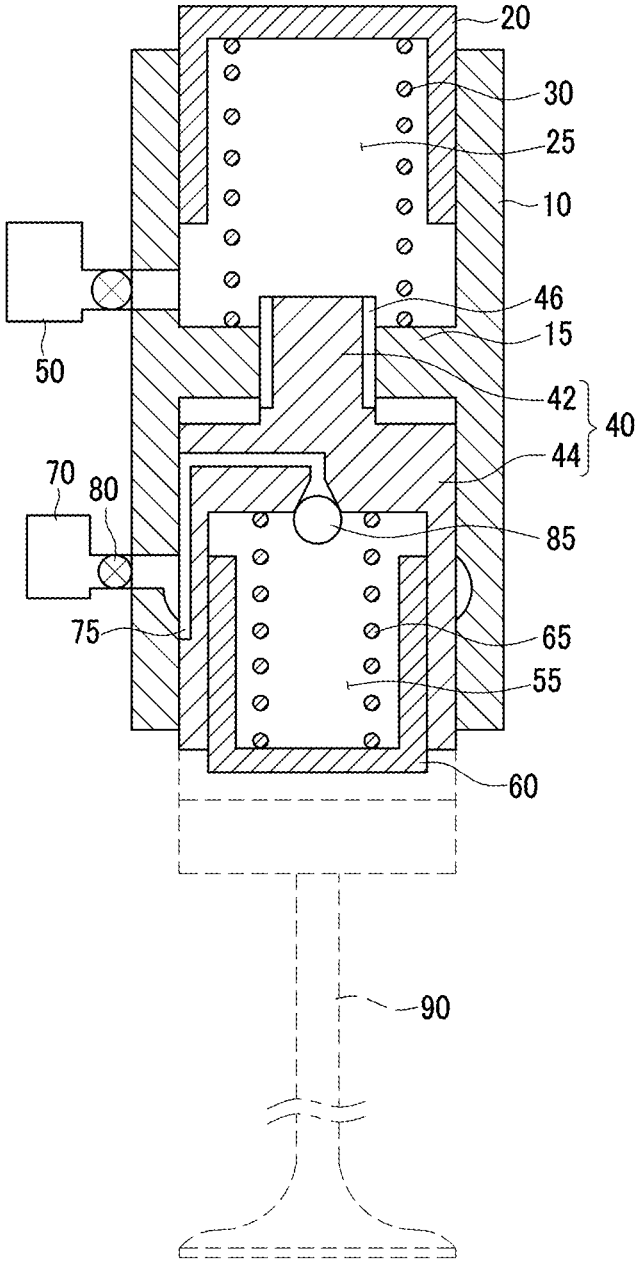
FIG. 1 is a cross-sectional view of an electro-hydraulic variable valve apparatus according to the first exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 3:
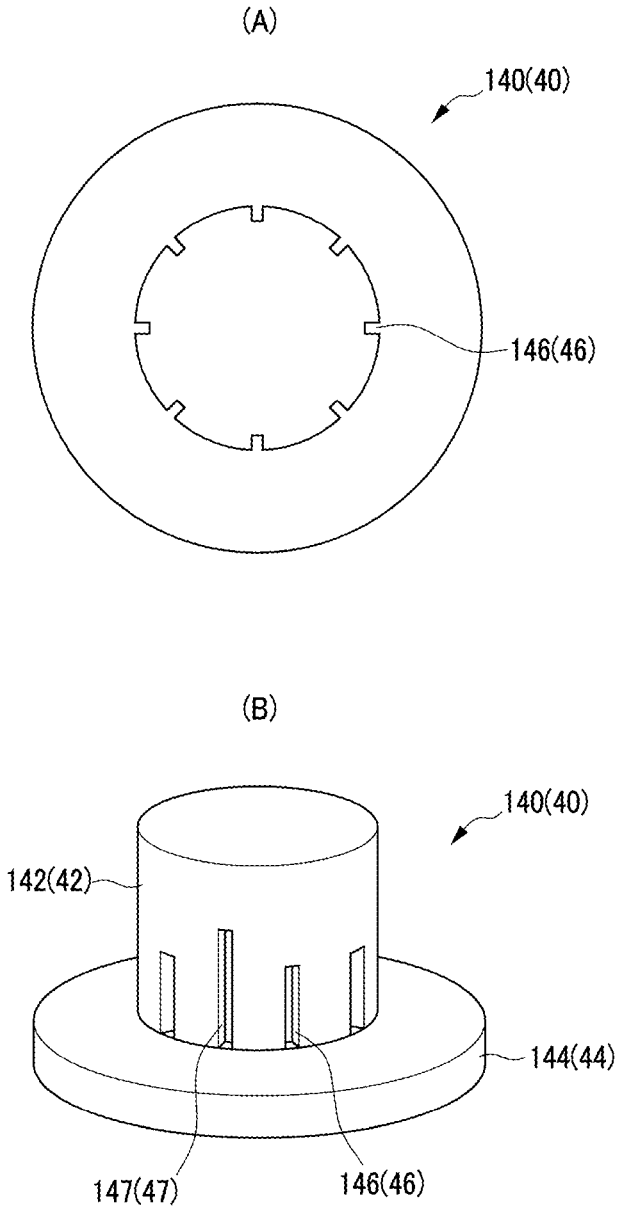
FIG. 3 is a drawing showing a dependent piston of the first and second exemplary embodiments of the present invention.

FIG. 1 is a cross-sectional view of an electro-hydraulic variable valve apparatus according to the first exemplary embodiment of the present invention and FIG. 3 is a drawing showing a dependent piston of the first and second exemplary embodiments of the present invention.

Referring to FIG. 1 and FIG. 3, an electro-hydraulic variable valve apparatus according to the first exemplary embodiment of the present invention includes a valve unit housing 10 of which a guide protrude portion 15 is formed therein, a main piston 20 which is disposed to the valve unit housing 10 and defines a valve adjusting oil chamber 25 with the valve unit housing 10, a main spring 30 which is disposed within the valve adjusting oil chamber 25 and elastically supports the main piston 20, a dependent piston 40 which is disposed within the valve unit housing 10, is guided along the guide protrude portion 15, reciprocates according to reciprocation of the main piston 20, and opens a valve 90 and a main oil supply portion 50 which supplies hydraulic pressure to the valve adjusting oil chamber 25.

The dependent piston 40 includes a first dependent piston body 42 guided along the guide protrude portion 15 and a second dependent piston body 44 guided along the valve unit housing 10.

The dependent piston 40, in the first exemplary embodiment of the present invention, includes a valve lash adjusting piston 60 which is disposed within the dependent piston 40 and defines a valve lash adjusting chamber 55 with the dependent piston 40, a valve lash adjusting spring 65 which is disposed within the dependent piston 40 and elastically supports the valve lash adjusting piston 60 and a valve lash adjusting oil supply portion 70 which supplies oil to the valve lash adjusting chamber 55.

In an exemplary embodiment of the present invention, the apparatus may further include a check valve 85 which is disposed between the valve lash adjusting oil supply portion 70 and the valve lash adjusting chamber 55.

A plurality of grooves 46 may be formed to the first dependent piston body 42 along reciprocal motion direction of the dependent piston 40 and at least one groove 47 may be longer than the other groove 46.

Hereinafter, operations of the electro-hydraulic variable valve apparatus according to the first exemplary embodiment of the present invention will be described. The main oil supply portion 50 supplies oil to the valve adjusting oil chamber 25, and a cam 201 (referring to FIG. 4) pushes the main piston 20 and then the dependent piston 40 opens the valve 90.

In this moment, the oil may be gradually leaked between the guide protrude portion 15 and the groove 46 and 47 formed to the first dependent piston body 42 so that impacts of opening and closing of the valve 90 can be reduced.

Supplying oil amount of the main oil supply portion 50 can be controlled by an ECU (electronic control unit), and the operations of the ECU is well known in the art so further detailed explanations will be omitted.

The valve lash adjusting oil supply portion 80 can supply oil to the valve lash adjusting chamber 55 through a valve lash adjusting oil passage 75, so that an additional HLA (hydraulic lash adjuster) does not need to be equipped.

Figure 2:
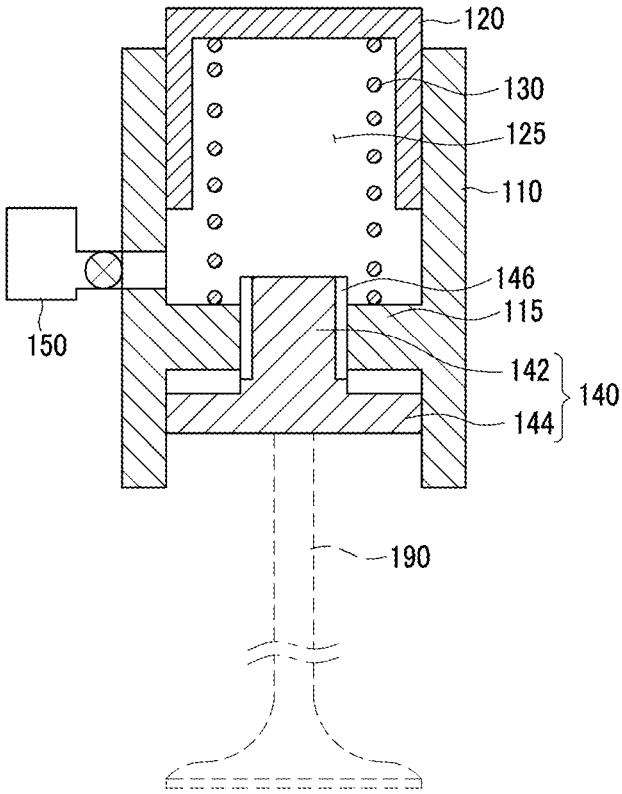
FIG. 2 is a cross-sectional view of an electro-hydraulic variable valve apparatus according to the second exemplary embodiment of the present invention.

FIG. 2 is a cross-sectional view of an electro-hydraulic variable valve apparatus according to the second exemplary embodiment of the present invention.

Referring to FIG. 2 and FIG. 3, an electro-hydraulic variable valve apparatus according to the second exemplary embodiment of the present invention includes a valve unit housing 110 of which a guide protrude portion 115 is formed therein, a main piston 120 which is disposed to the valve unit housing 110 and defines a valve adjusting oil chamber 125 with the valve unit housing 110, a main spring 130 which is disposed within the valve adjusting oil chamber 125 and elastically supports the main piston 120, a dependent piston 140 which is disposed within the valve unit housing 110, is guided along the guide protrude portion 115, reciprocates according to reciprocation of the main piston 120, and opens a valve 190 and a main oil supply portion 150 which supplies hydraulic pressure to the valve adjusting oil chamber 125.

The dependent piston 140 includes a first dependent piston body 142 guided along the guide protrude portion 115 and a second dependent piston body 144 guided along the valve unit housing 110.

A plurality of grooves 146 may be formed to the first dependent piston body 142 along reciprocal motion direction of the dependent piston 140 and at least one groove 147 may be longer than the other groove 146.

Comparing to the first exemplary embodiment of the present invention, the electro-hydraulic variable valve apparatus according to the second exemplary embodiment of the present invention does not include the valve lash adjusting piston 60 and the valve lash adjusting oil supply portion 70 so that elements and scheme can be simplified and manufacturing cost can be reduced, too.

Except for operations of the valve lash adjusting comparing to the first exemplary embodiment of the present invention, detailed explanation of the operation of the electro-hydraulic variable valve apparatus according to the second exemplary embodiment of the present invention will be omitted.

Figure 4:
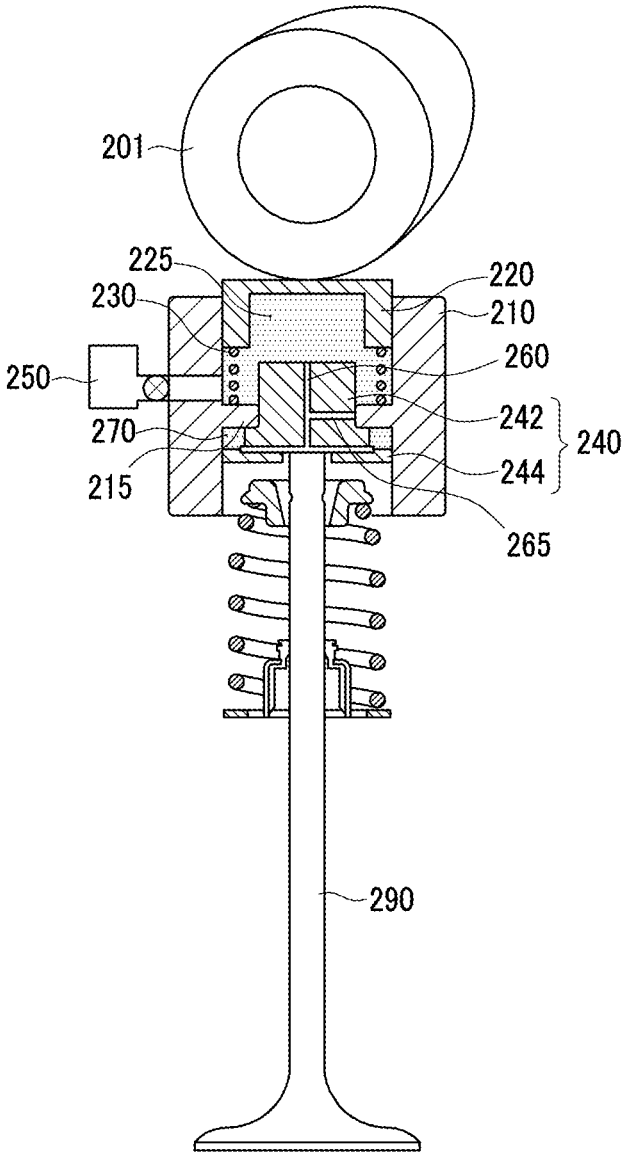
FIG. 4 is a cross-sectional view of an electro-hydraulic variable valve apparatus according to the third exemplary embodiment of the present invention showing a state that a valve is closed.

FIG. 4 is a cross-sectional view of an electro-hydraulic variable valve apparatus according to the third exemplary embodiment of the present invention showing a state that a valve is closed.

Referring to FIG. 4, an electro-hydraulic variable valve apparatus according to the third exemplary embodiment of the present invention includes a valve unit housing 210 of which a guide protrude portion 215 is formed therein, a main piston 220 which is disposed to the valve unit housing 210 and defines a valve adjusting oil chamber 225 with the valve unit housing 210, a main spring 230 which is disposed within the valve adjusting oil chamber 225 and elastically supports the main piston 220, a dependent piston 240 which is disposed within the valve unit housing 210, is guided along the guide protrude portion 215, reciprocates according to reciprocation of the main piston 220, and opens a valve 290 and a main oil supply portion 250 which supplies hydraulic pressure to the valve adjusting oil chamber 225.

The dependent piston 240 includes a first dependent piston body 242 guided along the guide protrude portion 215 and a second dependent piston body 244 guided along the valve unit housing 210.

The guide protrude portion 215 and the second dependent piston body 244 defines an auxiliary chamber 270 and a first impact reducing oil passage 260 is formed to the dependent piston 240 for connecting the valve adjusting oil chamber 225 and the auxiliary chamber 270. The apparatus further include a second impact reducing oil passage 265 which is diverged from the first impact reducing oil passage 260 to the guide protrude portion 215.

The first impact reducing oil passage 260 and the second impact reducing oil passage 265 allow partial oil to be gradually leaked out to reduce impact in closing and opening of the valve 290 when a cam 201 pushes the main piston 220. Especially the second impact reducing oil passage 265 can be closed and opened by the guide protrude portion 215 so that impact and vibration induced by opening and closing of the valve 290 can be prevented.

Figure 5:
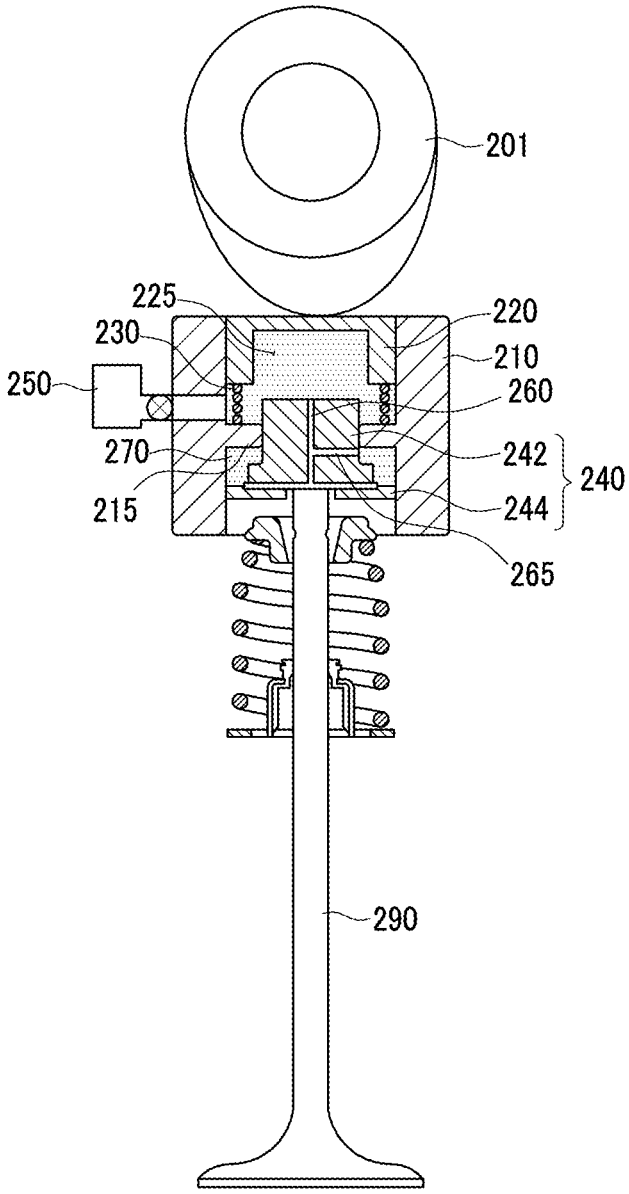
FIG. 5 is a cross-sectional view of an electro-hydraulic variable valve apparatus according to the third exemplary embodiment of the present invention showing a state that a valve is opened.
Figure 6:
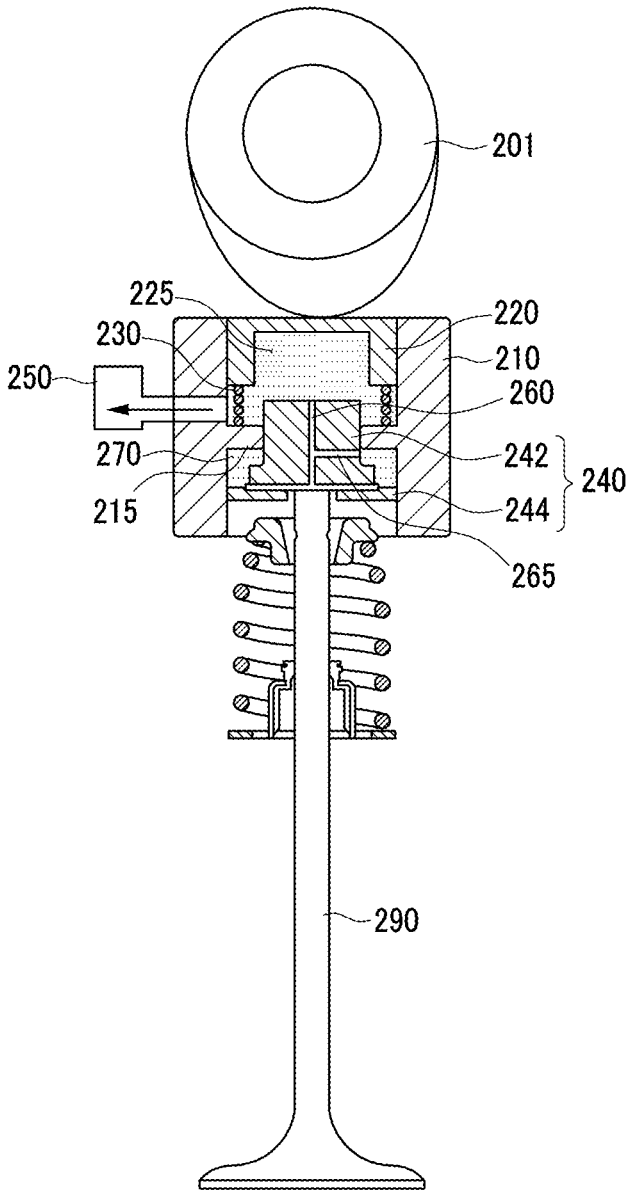
FIG. 6 is a cross-sectional view of an electro-hydraulic variable valve apparatus according to the third exemplary embodiment of the present invention showing a state that hydraulic pressure is released when a valve is opened.
Figure 7:
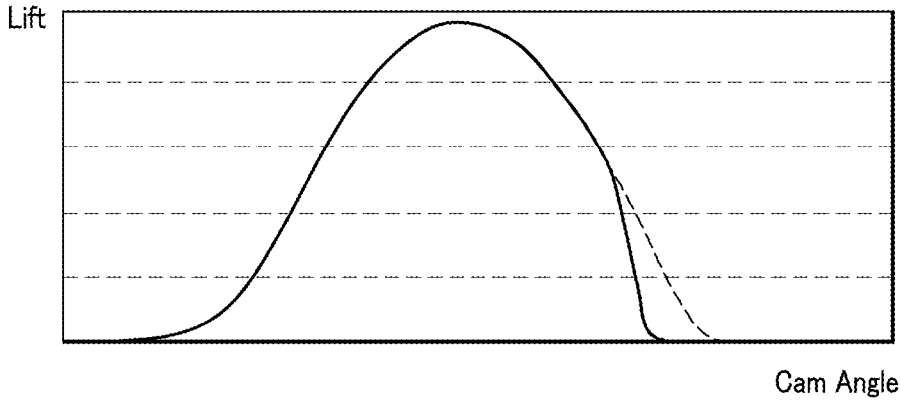
FIG. 7 is a graph showing that hydraulic pressure is released when a valve is opened in the third embodiment of the present invention.

FIG. 5 is a cross-sectional view of an electro-hydraulic variable valve apparatus according to the third exemplary embodiment of the present invention showing a state that a valve is opened, FIG. 6 is a cross-sectional view of an electro-hydraulic variable valve apparatus according to the third exemplary embodiment of the present invention showing a state that hydraulic pressure is released when a valve is opened, and FIG. 7 is a graph showing that hydraulic pressure is released when a valve is opened in the third embodiment of the present invention.

As shown FIG. 4 and in FIG. 5, the oil is supplied to the valve adjusting oil chamber 225 by the operation of the main oil supply portion 250 and lift of the valve 290 can be modulated.

Referring to FIG. 6, valve lift can be controlled just before the valve 290 is completely closed, that is, the main oil supply portion 250 is controlled to release the oil when the valve 290 is opened.

And thus, as shown in FIG. 7, valve lift is changed from general valve lift line (solid line) to modified valve lift (dotted line). This controlling induces early closing of the valve when reducing of opening interval of the valve is required.

As described above, the electro-hydraulic variable valve lift apparatus according to the exemplary embodiments of the present invention may simplify elements so that manufacturing cost can be reduced. And impacts of opening and closing of the valve can be reduced and early closing of the valve can be induced when it is required so that engine performance can be enhanced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electro-hydraulic variable valve lift apparatus comprising:

a valve unit housing of which a guide protrude portion is formed therein;

a main piston which is slidably disposed in the valve unit housing and defines a valve adjusting oil chamber with the valve unit housing;

a main spring which is disposed within the valve adjusting oil chamber and elastically supports the main piston on the guide protrude portion;

a dependent piston which is slidably disposed within the valve unit housing, is guided along the guide protrude portion, reciprocates according to reciprocation of the main piston, and opens a valve; and a main oil supply portion which selectively supplies hydraulic pressure to the valve adjusting oil chamber;

wherein the dependent piston comprises:

a first dependent piston body guided along the guide protrude portion; and a second dependent piston body guided along the valve unit housing;

wherein the guide protrude portion, the second dependent piston body and the valve unit housing define an auxiliary chamber therebetween;

wherein a first impact reducing oil passage is formed to the dependent piston and connects the valve adjusting oil chamber and the auxiliary chamber; and wherein the apparatus further comprises a second impact reducing oil passage which is diverged from the first impact reducing oil passage toward the guide protrude portion such that the second impact reducing oil passage is selectively blocked by the guide protrude portion in accordance with reciprocal motion of the dependent piston.

2. The apparatus of claim 1, wherein the dependent piston further comprises:

a valve lash adjusting piston which is disposed within the second dependent piston body and defines a valve lash adjusting chamber with the second dependent piston body;

a valve lash adjusting spring which is disposed within the second dependent piston body and elastically supports the valve lash adjusting piston; and a valve lash adjusting oil supply portion which supplies oil to the valve lash adjusting chamber.

3. The apparatus of claim 2, wherein the apparatus further comprises a check valve which is disposed between the valve lash adjusting oil supply portion and the valve lash adjusting chamber.

4. The apparatus of claim 1, wherein a plurality of grooves are formed to the first dependent piston body along reciprocal motion direction of the dependent piston.

5. The apparatus of claim 4, wherein the plurality of grooves are formed on an outer circumference of the first dependent piston body.

6. The apparatus of claim 1, wherein a plurality of grooves are formed to the first dependent piston body along reciprocal motion direction of the dependent piston and at least one groove is longer than the other grooves to be fluid-connected to the valve adjusting oil chamber.

7. The apparatus of claim 6, wherein the plurality of grooves are formed on an outer circumference of the first dependent piston body.

8. An electro-hydraulic variable valve lift apparatus comprising:

a valve unit housing;

a main piston which is slidably disposed in the valve unit housing and defines a valve adjusting oil chamber with the valve unit housing;

a main spring which is disposed within the valve adjusting oil chamber and elastically supports the main piston;

a dependent piston which is guided along the valve unit housing, reciprocates according to reciprocation of the main piston, and opens a valve; and a main oil supply portion which supplies hydraulic pressure to the valve adjusting oil chamber;

wherein the apparatus further comprises a guide protrude portion formed to the valve unit housing, and the dependent piston comprises:

a first dependent piston body guided along the guide protrude portion; and a second dependent piston body guided along the valve unit housing;

wherein the guide protrude portion, the second dependent piston body and the valve unit housing define an auxiliary chamber therebetween;

wherein a first impact reducing oil passage is formed to the dependent piston for connecting the valve adjusting oil chamber and the auxiliary chamber; and wherein a second impact reducing oil passage is diverged from the first impact reducing oil passage toward the guide protrude portion such that the second impact reducing oil passage is selectively blocked by the guide protrude portion in accordance with reciprocal motion of the dependent piston.

9. The apparatus of claim 8, wherein the apparatus further comprises a guide protrude portion formed to the valve unit housing, and the dependent piston comprises:

a first dependent piston body guided along the guide protrude portion; and a second dependent piston body guided along the valve unit housing;

wherein a plurality of grooves are formed to the first dependent piston body along reciprocal motion direction of the dependent piston.

10. The apparatus of claim 9, wherein the plurality of grooves are formed on an outer circumference of the first dependent piston body.

11. The apparatus of claim 9, wherein the guide protrude portion is disposed in the valve unit housing and the main spring is positioned between the guide protrude portion and the main piston.

12. The apparatus of claim 8, wherein the guide protrude portion is disposed in the valve unit housing and the main spring is positioned between the guide protrude portion and the main piston.

* * * * *